US011319103B2

(12) United States Patent
Singh et al.

(10) Patent No.: US 11,319,103 B2
(45) Date of Patent: May 3, 2022

(54) HAND-HELD APPARATUS FOR EXTRACTING CONTENTS OF SACHET/POUCH

(71) Applicants: Gurdeep Singh, Ludhiana (IN); Sougata Karmakar, Kamrup (IN); Abhishek Singh, Jamshedpur (IN); Amandeep Verma, Bijnor (IN); Sangeeta Bhanja Chaudhuri, Kolkata (IN)

(72) Inventors: Gurdeep Singh, Ludhiana (IN); Sougata Karmakar, Kamrup (IN); Abhishek Singh, Jamshedpur (IN); Amandeep Verma, Bijnor (IN); Sangeeta Bhanja Chaudhuri, Kolkata (IN)

( * ) Notice: Subject to any disclaimer, the term of this patent is extended or adjusted under 35 U.S.C. 154(b) by 0 days.

(21) Appl. No.: 17/092,144

(22) Filed: Nov. 6, 2020

(65) Prior Publication Data

US 2021/0292031 A1 Sep. 23, 2021

(51) Int. Cl.
*B65B 69/00* (2006.01)

(52) U.S. Cl.
CPC ..... *B65B 69/005* (2013.01); *B65B 69/0008* (2013.01); *B65B 69/0033* (2013.01)

(58) Field of Classification Search
CPC ..... B65B 69/005; B65B 69/0008; B65B 69/0033
USPC ..... 414/412
See application file for complete search history.

(56) References Cited

U.S. PATENT DOCUMENTS

2017/0099803 A1* 4/2017 Neighbors ..... A01K 5/0208
2021/0094719 A1* 4/2021 Franke ..... B65B 69/0041

* cited by examiner

*Primary Examiner* — Glenn F Myers
(74) *Attorney, Agent, or Firm* — Kunzler Bean & Adamson, PC

(57) ABSTRACT

A hand-held apparatus for extracting the contents of a sachet/pouch is disclosed. The hand-held apparatus includes a roller press assembly and a roller glider cum collection bin being disposed below the roller press assembly. The roller press assembly further includes a handle, a detachable frame coupled to a handle and a clamp. The detachable frame is provided with a roller for squeezing the contents of a sachet/pouch. The clamp is provided over the detachable frame and the clamp is coupled to a cutter for cutting the sachet/pouch. The roller glider cum collection bin includes a base for receiving the roller press assembly. The base includes a plurality of holes and a guide rail for providing a channel for the cutter. A collection bin is provided at the bottom of the base for collecting the contents of the sachet/pouch through the plurality of holes.

7 Claims, 4 Drawing Sheets

HAND-HELD APPARATUS FOR EXTRACTING CONTENTS OF SACHET/POUCH

CROSS REFERENCES TO RELATED APPLICATIONS

This application claims priority to Indian Patent Application Number 202011011370 entitled "DESIGN OF SAFETY-ENRICHED SITTING-POSITION ORIENTED HAND-HELD APPARATUS FOR DAMAGED POUCH AND SACHET CUTTING FOR RE-WORK IN FMCG INDUSTRIES" and filed on Mar. 17, 2020 for Gurdeep Singh, et al., which is incorporated herein by reference in its entirety for all purposes.

FIELD OF INVENTION

The present invention relates to a hand-held apparatus. More specifically, the present invention relates to a hand-held apparatus for extracting the contents of a sachet/pouch.

PRIOR ART AND PROBLEM TO BE SOLVED

The Fast Moving Consumer Goods (FMCGs) are low-priced items that are used with a single or limited number of consumption occasions and are also sometimes referred to as consumer packaged goods or groceries. FMCG is composed of three major product segments Food, Beverage, and Household/Personal Care products. FMCG is an essential part of day to day life of every person across the globe and accounts for more than half of all consumers spending. The production process of FMCG industries involves various make and pack activities being carried out on fast-paced parallel assembly lines built upon shop-floor areas. These activities include packing of finished goods, labeling, and stamping of cartons, segregating the defective finished goods for re-work, dispatching the finished goods, etcetera. Ignorance towards Ergonomics—the science of human-machine compatibility is the distinctive feature of such industries, and such industries often neglect the safety features in their working activities too.

Re-work of defective liquid-filled pouches/sachets is one of such prominent activity related to FMCG shop-floor, especially in Food Processing (jams/jellies/pickles) and Personal Care Products (hair oil/shampoo/liquid detergent). Often while manufacturing the sachets/pouches on highly paced assembly, the finished pouches are rejected due to various quality reasons viz. non-printing of proper batch numbers (label graphic details), inadequately filled quantity, shrinkage of pouches/sachets (due to overheating/vibrating machines), improper cutting (as per standards) etcetera. In such cases, only the outer part of pouches is considered as waste, whereas the in-filled liquid (oil/shampoo) is extracted out to be collected and further re-used for fresh filling in the new products (pouches/sachets). This becomes the re-work activity of pouch/sachet cutting, which is the full-time activity on FMCG shop-floor as FMCGs are low cost—high volume products (1 lakh pouches per day, 25-30 percent wastage, i.e., 25,000 pouches re-worked daily). Such pouch cutting activities are often carried out using sharp-edged blades/cutters, which are used with bare hands and that too with slippery hands causing cuts and injuries and becomes a safety concern for factory management.

Therefore, there arises a requirement of an apparatus which overcomes the aforementioned challenges associated with the conventional re-work tools/techniques.

THE OBJECTIVE OF THE INVENTION

It is common for commodities to be packed in closed envelopes, sachets, or pouch and sachet, which in this specification will be referred to collectively as pouch and sachet. The commodities can be particulate or liquid. Comestibles, cosmetic or pharmaceutical preparations, and general household materials such as cleansers inclusive of shampoos, hair-oil, pickles, jams, and jellies are examples of the many products (content) which are packaged in pouch and sachet. During manufacture, faulty filled pouch and sachet may be produced from time to time which has to be rejected during subsequent inspection or packing operations. It is considered desirable to forcefully cut open the faulty pouch and sachet to recover the contents therefrom, particularly when the commodity is relatively precious. The recovered contents can then be reprocessed and used again in the manufacture of fault-free pouch and sachet.

The apparatus of the present invention prevents direct exposure of bare and slippery hands to sharp cutters and blades thereby ensuring the safety of the user performing re-work activities using the apparatus.

Further, the apparatus of the present invention is used by the user in a sitting-position to reduce the stress of working in a standing position thereby making the work easy to perform with enhanced efficiency and productivity.

The manually operable apparatus of the present invention includes a roller press assembly and a roller glider cum collection bin. The roller press assembly includes a handle, a detachable frame provided with a roller and a clamp coupled to a blade/cutter for cutting the sachet/pouch. The roller is capable of extracting out the contents from the pierced (cut) pouches/sachets by effectively rolling and pressing upon such pouches and sachets. The roller of the apparatus can be replaced (after wear and tear) by merely pulling the frames aside.

The roller of the apparatus eliminates the manual need of squeezing out the contents by pressing the pouch/sachet with bare hands and thus keeps the hand clean and dry.

The clamped cutter/blade of the present invention can be adjusted to any length as per the use just by opening/closing a wing nut provided upon the top of the C-clamp.

The roller glider cum collection bin of the present invention includes a plurality of holes that enable the extracted liquid (content) to be collected in a collection bin. A primary tanker/container may further be connected to the collection bin through an opening using valves and pipes. Further, the apparatus of the present invention is made of stainless steel material to prevent contamination of the liquid contents being extracted due to rust or other forms of reaction.

SUMMARY OF THE INVENTION

The present invention relates to a hand-held apparatus for extracting the contents of a sachet/pouch. A roller press assembly of the hand-held apparatus includes a handle, a detachable frame coupled to a handle and a clamp. The detachable frame is further provided with a roller for squeezing the contents of a sachet/pouch. The clamp is provided over the detachable frame coupled to a cutter for cutting the sachet/pouch. A roller glider cum collection bin of the hand-held apparatus includes a base for receiving the roller press assembly. The base includes a plurality of holes for collecting the contents of the sachet/pouch in a collection bin provided at the bottom of the base. The base further includes a guide rail for providing a channel for the cutter. In the packaging art particularly in manufacturing filled packages formed with envelopes having contents of the character described, as for example, in making shampoo, sachets, or in packaging oil in small envelopes and it has often been found commercially impractical to salvage the contents of such filled packages which have been spoiled or otherwise found defective due to high labor costs and involvements of relatively slow and tedious hand operations required to reclaim the same. It is to this class of reclamation the present invention has been found to have great utility. So here, a sitting position oriented hand-held device is designed which is capable of extracting the liquid from the sachet without letting the blade or cutter touch the hand of the user ensuring safety and efficiency. The device can work efficiently to quickly extract the liquid and to retrieve the content from the damaged packaging, which can be re-used. The device further includes a tank/container attached at the lower end so that the extracted content can be filled into it. The work can be done in a sitting position making the work easy to perform with efficiency and enhanced productivity.

The foregoing features and other features as well as the advantages of the invention will become more apparent from the following detailed description, which proceeds with reference to the accompanying figures.

BRIEF DESCRIPTION OF DRAWINGS

The accompanying drawings, which are incorporated in and constitute a part of this disclosure, illustrate an exemplary embodiment and, together with the description, explain the disclosed embodiment. In the Figures, the left and rightmost digit(s) of a reference number identify the Figure in which the reference number first appears. The same numbers are used throughout the figures to reference like features and components. Some embodiments of the system and methods of an embodiment of the present subject matter are now described, by way of example only, and concerning the accompanying Figures, in which.

DETAILED DESCRIPTION OF THE INVENTION

Figure 1:
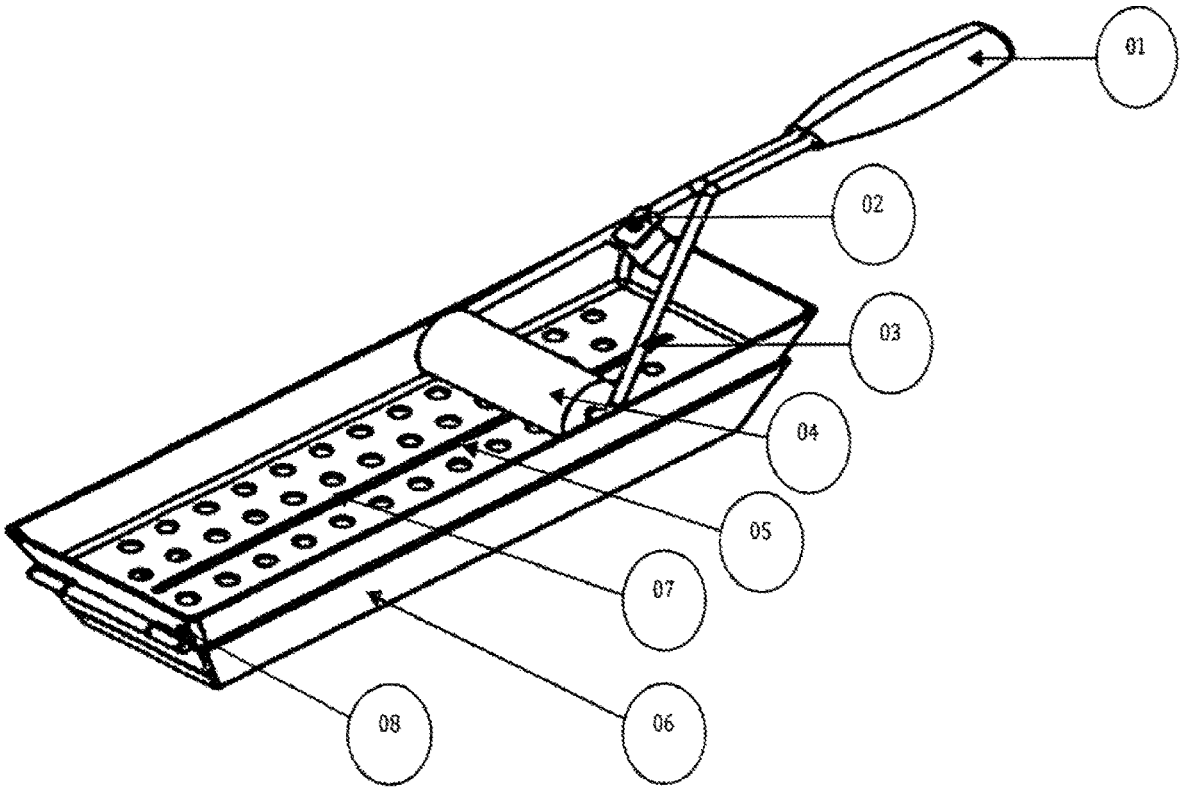
FIG. 1 illustrates the perspective view of a hand-held apparatus consisting of the roller glider cum collection bin with the holes (05), and the roller with the cutter having the handle (01), the C clamp (02) with the wing nut, the roller (04) and the detachable frame (03). The roller glider cum collection bin consists of guide rail for roller movement cum liquid collection bin (06), the guide rail (07) for the blade, and hinge (08) for opening the collection bin (06).

While the present invention is described herein by way of example, using various embodiments and illustrative drawings, those skilled in the art will recognize that the invention is neither intended to be limited to the embodiment of drawing or drawings neither described nor designed to represent the scale of the various components. Further, some components that may form a part of the invention may not be illustrated with specific figures for ease of illustration, and such omissions do not limit the embodiment outlined in any way. The drawings and detailed description of it are not intended to restrict the invention to the form disclosed, but on the contrary, the invention covers all modification/s, equivalents, and alternatives falling within the spirit and scope of the present invention as defined by the appended claims. The headings are used for organizational purposes only and are not meant to limit the scope of the description or the claims. As used throughout this specification, the word "may" be used in a permissive sense (i.e., meaning having the potential to), rather than the mandatory sense (i.e., meaning, must).

Further, the words "an" or "a" mean "at least one" and the word "plurality" means one or more unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and any additional subject matter not recited, and is not supposed to exclude any other additives, components, integers or steps. Likewise, the term "comprising" is considered synonymous with the terms "including" or "containing" for applicable legal purposes. Any discussion of documents acts, materials, devices, articles, and the like are included in the specification solely to provide a context for the present invention.

In this disclosure, whenever an element or a group of elements is preceded with the transitional phrase "comprising", it is also understood that it contemplates the same element or group of elements with transitional phrases "consisting essentially of", "consisting", "selected from the group comprising", "including", or "is" preceding the recitation of the element or group of elements and vice versa.

Before explaining at least one embodiment of the invention in detail, it is to be understood that the present invention is not limited in its application to the details outlined in the following description or exemplified by the examples. The invention is capable of other embodiments or of being practiced or carried out in various ways. Also, it is to be understood that the phraseology and terminology employed herein is for description and should not be regarded as limiting.

Unless otherwise defined, all technical and scientific terms used herein have the same meaning as commonly understood by one of ordinary skilled in the art to which the invention belongs. Besides, the descriptions, materials, methods, and examples are illustrative only and not intended to be limiting. Methods and materials similar or equivalent to those described herein can be used in the practice or testing of the present invention.

In accordance with the present disclosure, a hand-held apparatus used for extracting the contents of a sachet/pouch is disclosed. The present invention provides a safety-enriched sitting-position oriented handheld apparatus for safe re-working of liquid-filled pouches/sachets in Fast Moving Consumer Goods (FMCG) manufacturing industries without affecting their present working capacities and methodologies but will ensure safety in such re-work activities and enhanced productivity.

FIG. 1 shows a perspective view of the hand-held apparatus (or apparatus) of the present invention. The apparatus is made of stainless steel to prevent contamination of the contents of the pouch/sachet due to rust or other forms of reactions.

The hand-held apparatus is capable of piercing or cutting the damaged sachet forcefully to extract the content inside the un-usable sachet. The hand-held apparatus includes a roller that is capable of extracting out the contents from the pierced (cut) pouches/sachets by effectively rolling and pressing upon such pouches and sachets. The roller is capable of squeezing out the contents of the pouch/sachet by rolling and pressing on its own thus eliminating the manual need of squeezing out the contents by pressing. Hence, such an arrangement keeps the hands of the user clean and dry as compared to earlier situations where hand squeezing was an essential activity.

The design of the apparatus is so made that the roller can be replaced (after wear and tear) by merely pulling frames aside. To make the design compact, the commonly available industrial use paper cutter/blade can be easily integrated into the newly developed apparatus and can be used to its full length to reap out its maximum effective use. Different sizes of the blade frames can be used, as wing nut is capable of holding cutter body frames by screwing it tightly along its body frame.

As shown in the embodiment represented in FIG. 1, the hand-held apparatus of the present invention includes a roller press assembly and a roller glider cum collection bin that are structured to extract the contents of a sachet/pouch.

Figure 3:
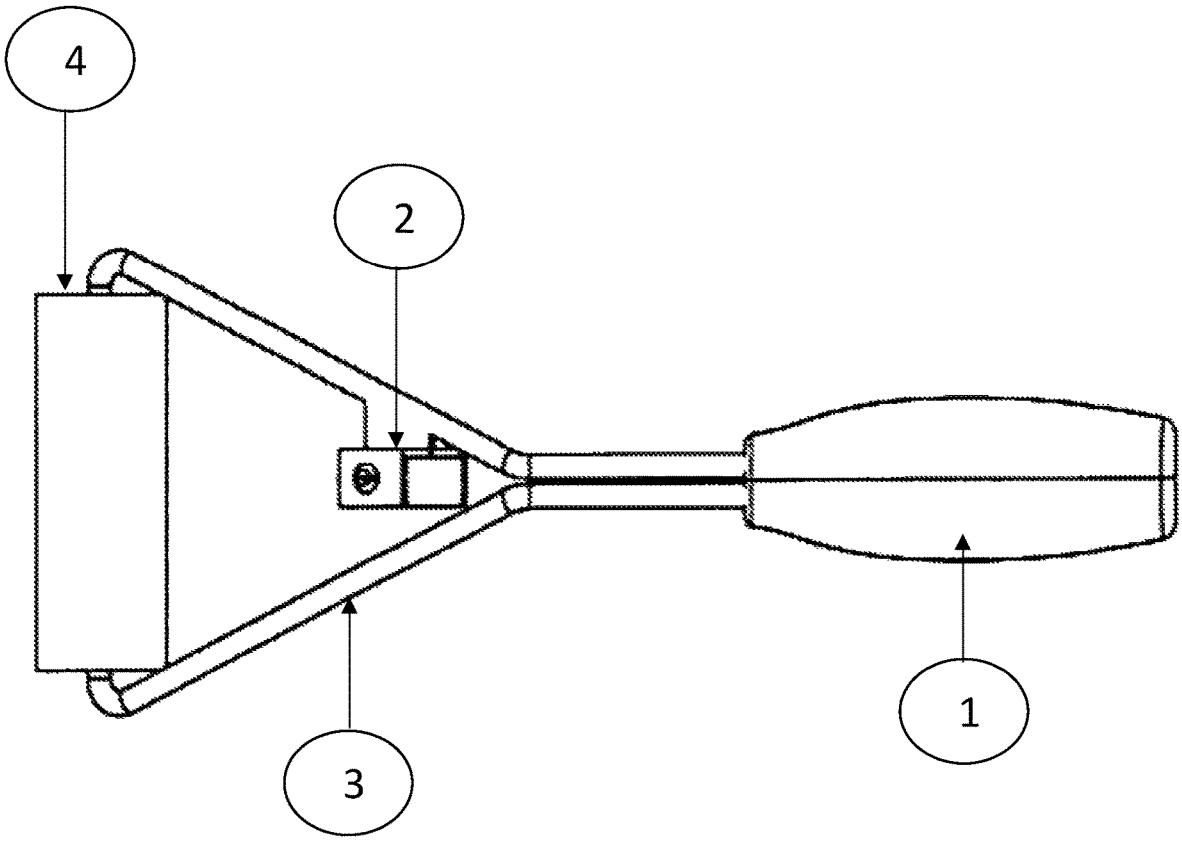
FIG. 3 shows the roller press assembly of the apparatus.

As shown in FIG. 1 and FIG. 3, the roller press assembly of the present invention includes a handle 1, a clamp 2, a frame 3 and a roller 4. As shown in FIG. 1, the handle 1 is attached at one end of the frame 3. The handle 1 may be used by a user for holding the roller press assembly. The handle 1 may include any conventional shape and dimensions. In an embodiment shown in FIG. 1, the handle 1 of the apparatus includes a cylindrical shape.

The frame 3 may be used to mount a blade/cutter and the roller 4. The frame 3 may be made of a pre-defined material and dimensions. In an embodiment shown in FIG. 1, the frame 3 of the apparatus is Y-shaped and is made of stainless steel.

Also, the frame 3 of the present invention may be a detachable frame. The frame 3 may be easily detachable so that components of the roller press assembly such as the roller 4 may be easily replaced when needed. The detachment of the frame 3 from the roller 4 may be easily done by merely pulling the frame 3 aside.

The frame 3 may include a clamp 2 which may be provided over the frame 3 in order to secure the blade/cutter (not shown). The blade/cutter may be any conventional blade/cutter capable of piercing through the sachet/pouch. The clamp 2 may be disposed on the frame 3 between the handle 1 and the roller 4. The clamp 2 may include any means to tighten or loosen the mounted blade/cutter thereby enabling the user to adjust a length of the blade/cutter as required. In an embodiment, the clamp 2 is a C-clamp with a wing nut to secure a blade/cutter to the rolling press assembly at a required length of the blade/cutter. The said feature allows the user to use a blade/cutter of any available size. The clamp 2 further helps to keep the blade/cutter intact and helps in holding the blade in a sturdy position while operating the apparatus.

The roller 4 may be coupled to the frame 3 such that the roller 4 can rotate freely. The roller 4 may be replaceable after wear and tear by merely pulling the frame 3 aside.

Figure 4:
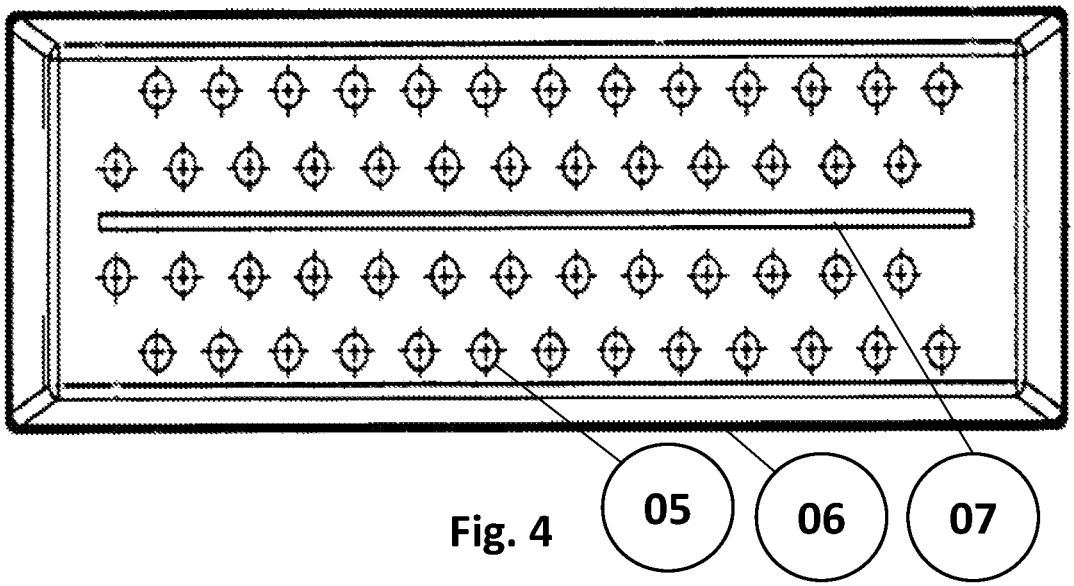
FIG. 4 shows the top view of the roller glider cum collection bin.
Figure 5:
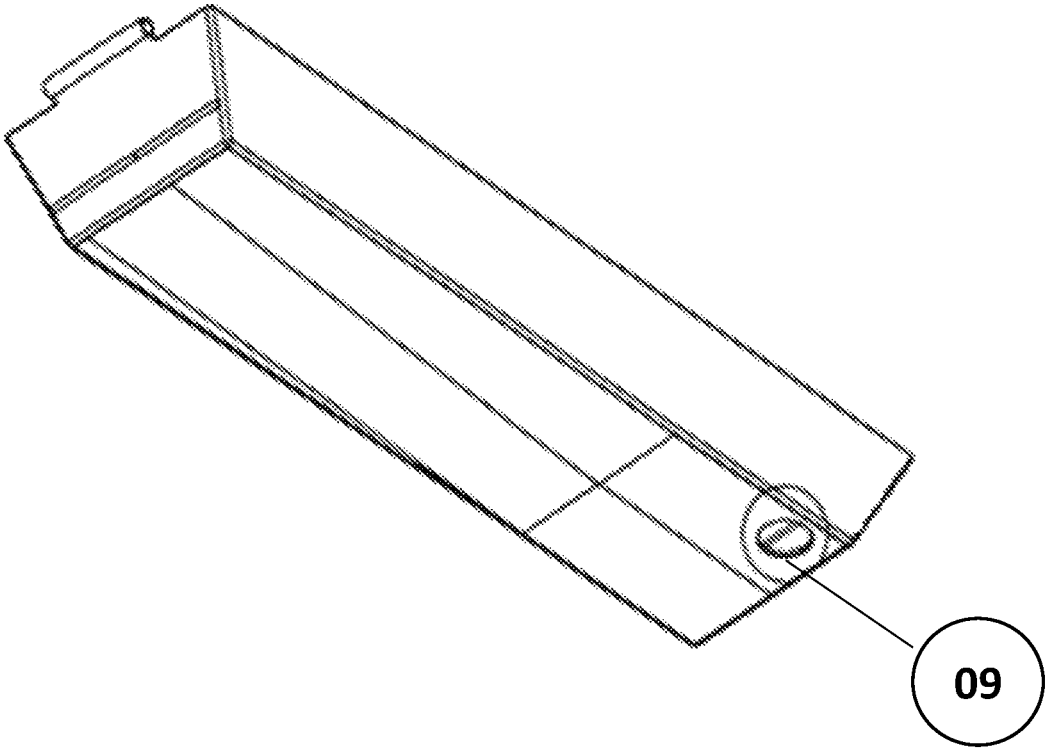
FIG. 5 illustrates the bottom view of the roller glider cum collection bin.

The roller glider cum collection bin of the apparatus is depicted in FIGS. 4 and 5. The roller glider cum collection bin may include a base with a plurality of holes 5 and a guide rail 7. The base may have a shape and structure so as to receive the roller press assembly and provides firm support for smooth movement of the roller press assembly within its boundaries. The plurality of holes 5 may be disposed over the base facilitating the contents of the pouch/sachet to pass through the base and be stored in a collection bin 6.

The guide rail 7 may be disposed along a length of the base such that the blade/cutter mounted on the roller press assembly aligns with the guide rail 7. The guide rail 7 may act as a channel for the blade/cutter when the roller 4 is rolled over the base.

Figure 2:
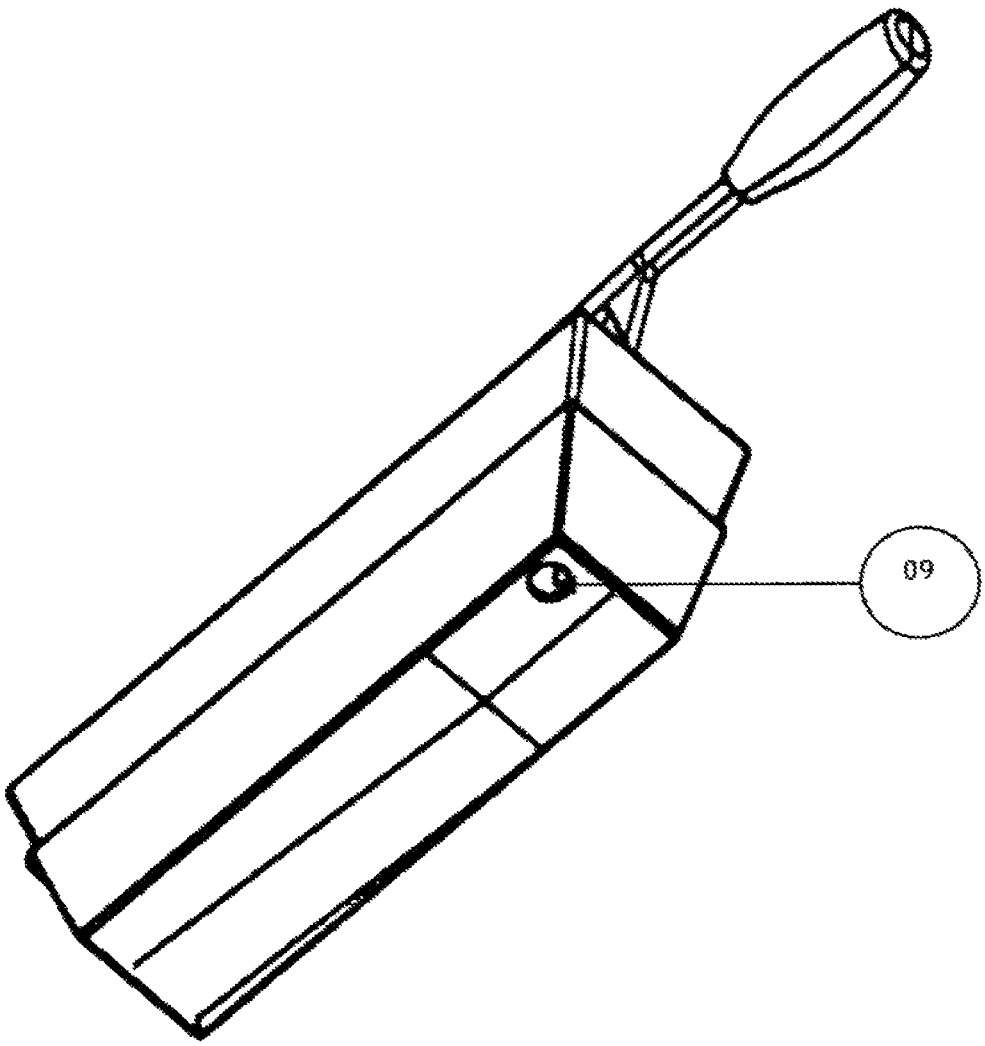
FIG. 2 shows the bottom view of the apparatus consisting of a hole opening (09) at the bottom of the collection bin (06) to integrate it further to the main collection drums.

The roller glider cum collection bin may further include the collection bin 6 to collect the contents of the sachet/pouch. The collection bin 6 may be disposed at the bottom of the base such that the contents of the sachet/pouch may be collected in the collection bin 6 after passing through the plurality of holes 5 present over the base. The collection bin 6 may further include an opening 9 (as shown in FIGS. 2 and 5) for collecting the contents of the sachet/pouch within any conventional primary tanker/collection drum (not shown). The collection drums may be integrated to the opening 9 through conventional valves and pipes.

The collection bin 6 may be coupled to the base through a hinge 8. The hinge 8 may enable the user to open the collection bin 6 for cleaning purposes.

The above disclosed apparatus of the present invention may be easily operated by the user. The user may place the sachet/pouch over the base and roll the roller press assembly over the sachet/pouch via the handle 1. The clamped cutter/blade and the roller 4 may then pierce and press the sachet/pouch kept over the base. During this operation, it is ensured that the blade/cutter is aligned with the guide rail 7. Thereafter, the contents of the sachet/pouch are extracted and collected within the collection bin 6 after passing through the holes 5 present over the base.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure and are not intended to be: construed as containing or implying limitation of the disclosure to those embodiments. There is a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

What is claimed is:

1. A hand-held apparatus for extracting contents of a sachet/pouch, the hand-held apparatus comprising:

a roller press assembly including:

a handle;

a detachable frame coupled to the handle, the detachable frame being provided with a roller for squeezing the contents of the sachet/pouch; and a clamp provided over the detachable frame, the clamp being coupled to a cutter for cutting the sachet/pouch;

a roller glider cum collection bin being disposed below the roller press assembly, the roller glider cum collection bin including:

a base for receiving the roller press assembly, the base including a plurality of holes and a guide rail for providing a channel for the cutter; and a collection bin being provided at the bottom of the base for collecting the contents of the sachet/pouch through the plurality of holes.

2. The hand-held apparatus of claim 1 wherein the apparatus is made of Stainless Steel.

3. The hand-held apparatus of claim 1 wherein the cutter includes a length which may be adjusted.

4. The hand-held apparatus of claim 1 wherein the roller is a replaceable roller.

5. The hand-held apparatus of claim 1 wherein the clamp includes a C-clamp with a wing nut.

6. The hand-held apparatus of claim 1 wherein the roller glider cum collection bin includes a hinge for opening the collection bin.

7. The hand-held apparatus of claim 1 wherein the collection bin includes an opening for integrating the hand-held apparatus to one or more collection drums.

* * * * *